United States Patent [19]

Mori

[11] 3,987,565

[45] Oct. 26, 1976

[54] INDEXING APPARATUS

[75] Inventor: Chuzo Mori, Tokyo, Japan

[73] Assignee: Carl Maufacturing Company Ltd., Tokyo, Japan

[22] Filed: Sept. 25, 1974

[21] Appl. No.: 509,232

Related U.S. Application Data

[63] Continuation-in-part of Ser. No. 415,974, Nov. 15, 1973, abandoned, which is a continuation-in-part of Ser. No. 198,257, Nov. 11, 1971, abandoned.

[30] Foreign Application Priority Data

| | | |
|---|---|---|
| Dec. 11, 1970 | Japan | 45-123642 |
| Dec. 11, 1970 | Japan | 45-123643 |
| Dec. 11, 1970 | Japan | 45-123644 |

[52] U.S. Cl. ..... 40/104.01

[51] Int. Cl.[2] ..... G09F 11/06

[58] Field of Search..... 40/104.01, 68.4, 78.05

[56] References Cited

UNITED STATES PATENTS

| | | | |
|---|---|---|---|
| 2,521,407 | 9/1950 | Pollock | 40/104.01 |
| 2,575,482 | 11/1951 | Berger | 40/104.01 |
| 2,785,489 | 3/1957 | Lannert | 40/104.01 |

FOREIGN PATENTS OR APPLICATIONS

| | | | |
|---|---|---|---|
| 652,338 | 4/1951 | United Kingdom | 40/104.01 |

*Primary Examiner*—Hugh R. Chamblee
*Assistant Examiner*—John H. Wolff
*Attorney, Agent, or Firm*—Phillips, Moore, Weissenberger, Lempio & Strabala

[57] ABSTRACT

The present invention provides an index apparatus comprising a base, a cover, locking and unlocking means, indexing means, a coil spring, cards etc. When compared with conventional ones, the apparatus of the present invention has the following main features. The construction and the fitting to impart the opening capacity to the cover of an index apparatus are very simple. To mention more fully, the opening capacity can easily be given to the cover only by inserting the coil spring in the contracted state into the projections on the base without conventional fastening with iron core inserted into the coil spring. Unlike conventional ones, the index means of the index apparatus in the present invention is simple in its construction and easy to fit. The indexing means consists of two parts, the indexing member made of semi-hard synthetic resin and the slider made of elastic material, and is characterized by its easy fitting without any processing.

4 Claims, 12 Drawing Figures

FIG_1
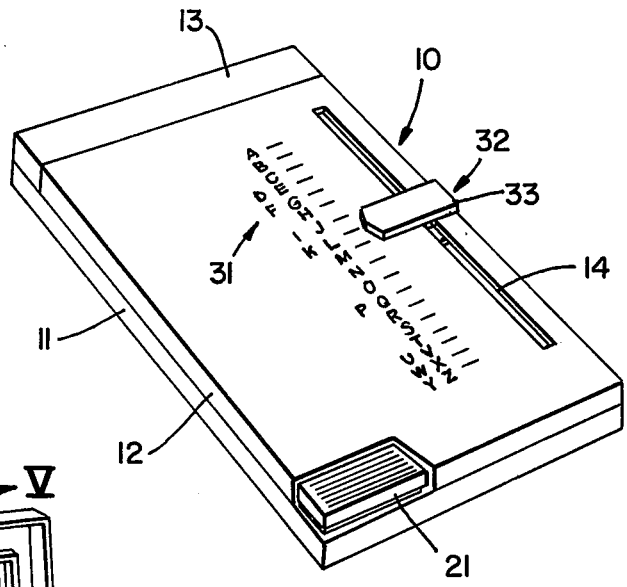
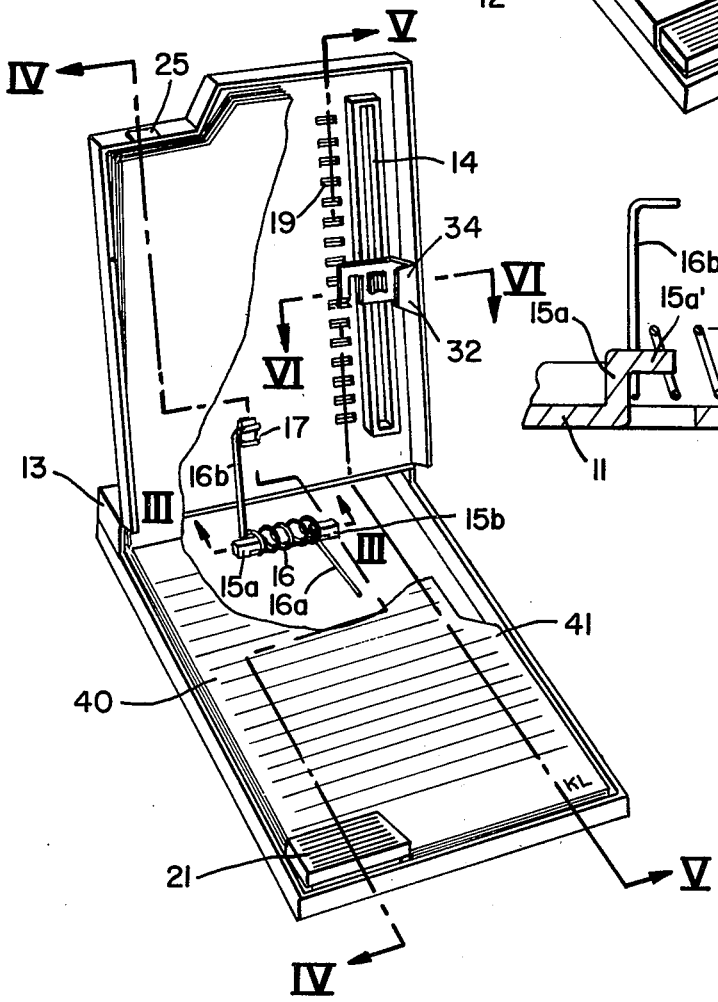
FIG_2
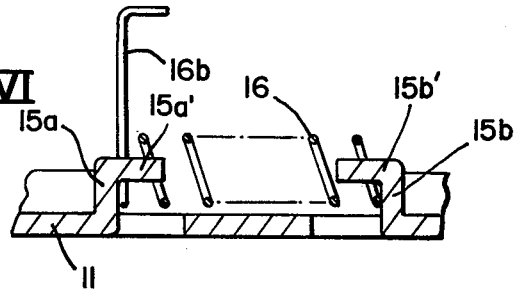
FIG_3

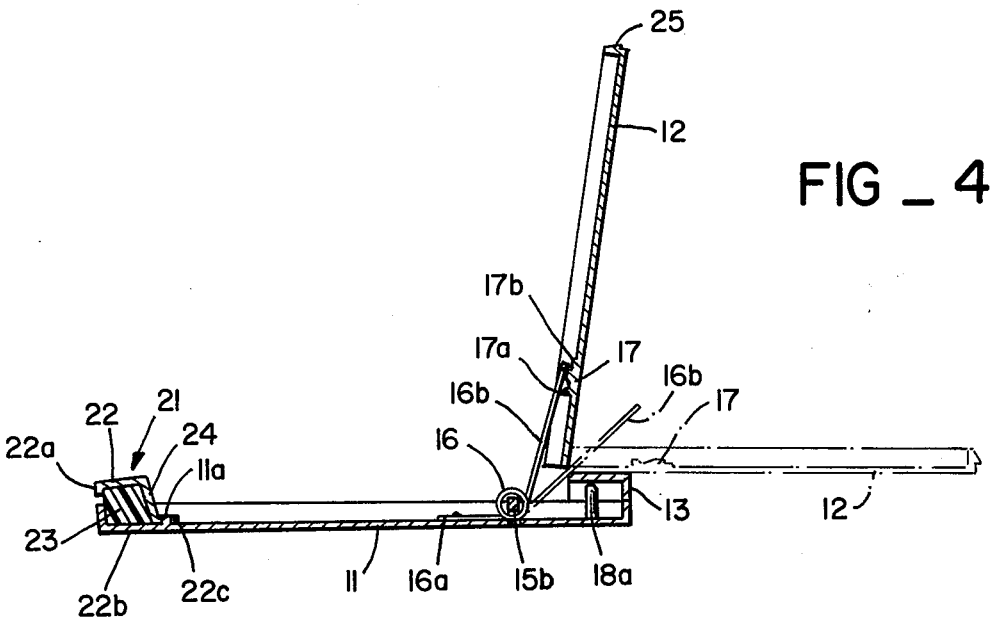
FIG _ 4
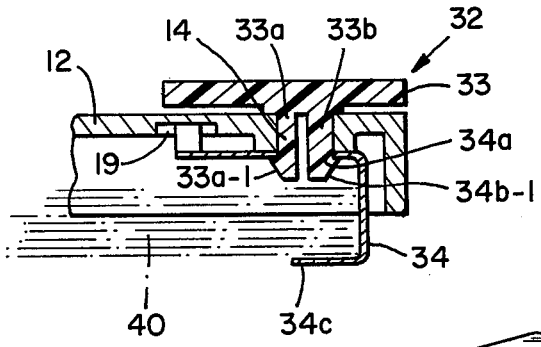
FIG _ 6
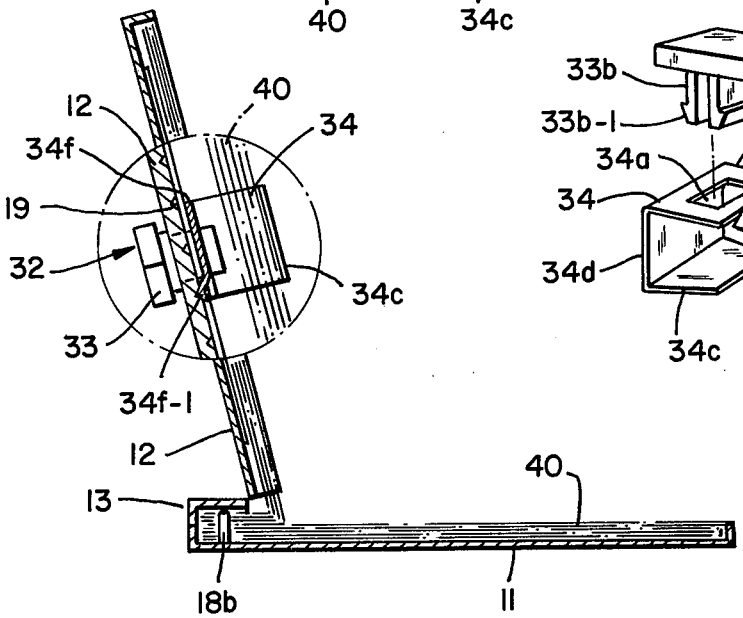
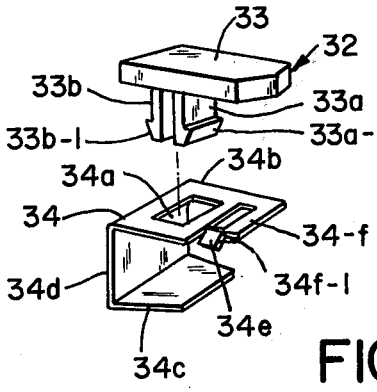
FIG _ 7
FIG _ 5

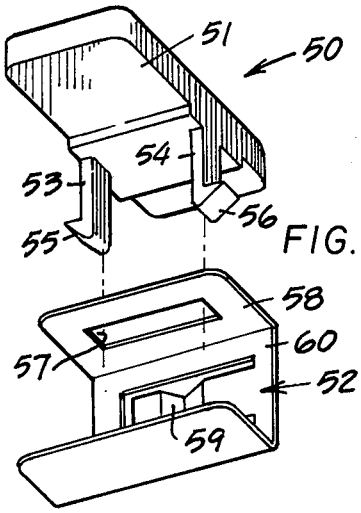
FIG. 8.
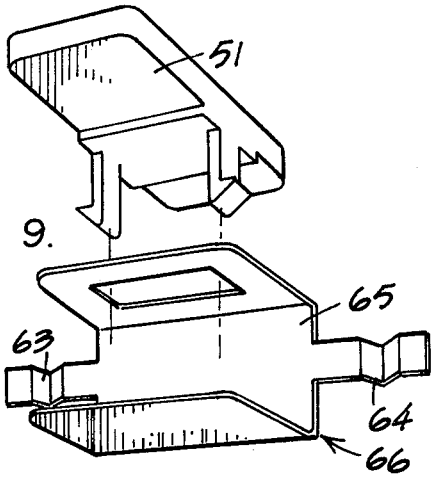
FIG. 9.
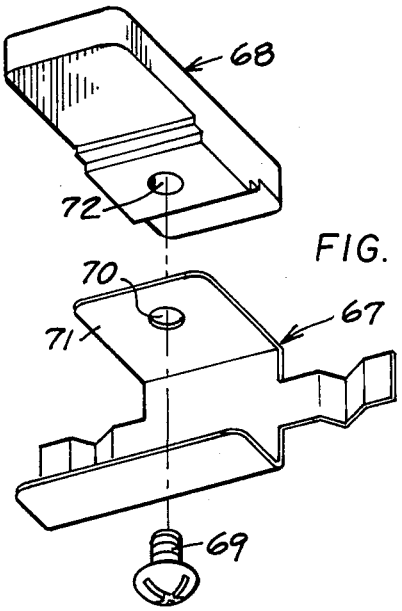
FIG. 10.
FIG. 12.
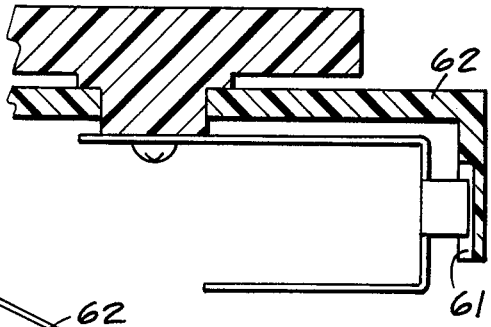
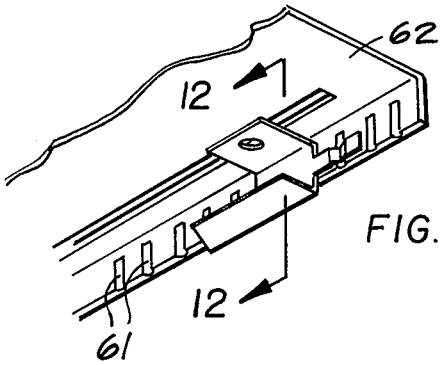
FIG. 11.

INDEXING APPARATUS

CROSS-REFERENCE TO RELATED APPLICATION

This application is a continuation-in-part of Application Ser. No. 415,974, filed Nov. 15, 1973, by Chuzo Mori, entitled "Indexing Apparatus", which was a continuation-in-part of Application Ser. No. 198,257, filed Nov. 11, 1971, by Chuzo Mori, entitled "Indexing Apparatus", both these cases now being abandoned.

SUMMARY OF THE INVENTION

The present invention provides an index apparatus comprising an elongated base, a cover coextension with a hinge connected along one transverse edge to said cover, a plurality of cards bound between said base and said cover along edges of said cards adjacent said hinge-connected edge of said cover, indexing marks on the top of said cover, each of said cards being adapted to carry thereon information related to one of said indexing marks, indexing means on said cover movable to a selected one of said indexing marks along a path of travel positioned adjacent one edge of said cover, said indexing means having an inner member movable along the inner surface of said cover when said indexing means is moved along said path of travel from one position to another position, said inner member having a portion extending along the bottom of said base from a position adjacent an edge of said base inwardly therefrom at a level below the undersurface of the lowermost card, said inner member being adapted to be lifted upwardly when said cover is opened to cause said inwardly extending portion of said inner member to engage the undersurface of a card, said cards each being formed with cutout portions along their edges adjacent said inner member, said cutouts having their lengths gradually varying in one direction of the thickness of said cards so that when said cover is opened with said indexing means being positioned in front of a selected one of said indexing marks, said indexing member is lifted by said cover with said inwardly extending portion holding some of said cards leaving a card corresponding to said selected indexing marks on the top of the stack of the cards remaining in said base.

BRIEF DESCRIPTION OF THE DRAWINGS

In the accompanying drawings, FIG. 1 is a perspective view of an embodiment of the index apparatus according to the present invention;

FIG. 2 is a similar view but illustrates the apparatus in its opened position with parts broken away;

FIG. 3 is an enlarged fragmentary cross-sectional view of the apparatus taken substantially along line III—III of FIG. 2;

FIG. 4 is a longitudinal sectional view of the apparatus taken substantially along line IV—IV of FIG. 2;

FIG. 5 is a longitudinal sectional view of the apparatus taken substantially along line V—V of FIG. 2;

FIG. 6 is an enlarged fragmentary cross-sectional view of the apparatus taken substantially along line VI—VI of FIG. 2;

FIG. 7 is an enlarged perspective view of indexing means in its disassembled position;

FIG. 8 is an enlarged perspective view of a second embodiment of indexing means;

FIG. 9 is an enlarged perspective view of a third embodiment of indexing means;

FIG. 10 is an enlarged perspective view of a fourth embodiment of indexing means;

FIG. 11 is a perspective view showing the indexing means of FIG. 10 in cooperation with the cover of the apparatus; and FIG. 12 is a sectional view taken along the line XII—XII of FIG. 11.

DESCRIPTION OF THE PREFERRED EMBODIMENTS

Referring first to FIG. 1 of the drawings, there is shown an embodiment of the index apparatus, generally indicated at 10, of the present invention. The apparatus is generally rectangular in plan view and includes a base 11, a cover 12 hinge-connected by means of a conventional hinge means (not shown) to an end member 13 which in turn is secured to the base 11. The cover 12 is shaped at one of the corners of the front portion thereof to accommodate a locking and unlocking member 21 which will be described in more detail later.

On the top of the cover 12, there are a series of indexing marks 31 arranged in a row extending in the longitudinal direction of the cover 12. In the illustrated embodiment of the invention, the indexing marks 31 are in the form of alphabets "A" to "Z" and lead lines to respective alphabetic letters. It is, however to be noted that other forms of indexing marks may be employed.

The cover 12 is formed in the top thereof with a slot 14 extending longitudinally of the cover 12 between the row of the indexing marks 31 and side edges of the cover 12 adjacent the row of the indexing marks. The apparatus also includes an indexing means which includes an indexing member 33 movable along the slot 14. The length of the slot 14 is the same as or greater than that of the row of the indexing marks 31 for the purpose to be made apparent later.

As will be seen in FIGS. 2, 3 and 4, the bottom of the base 11 is punched inwardly adjacent the end member 13 to form a pair of laterally aligned projections 15*a* and 16*a* extending upwardly from the bottom of the base 11. The projections 15*a* and 15*b* have horizontally inwardly directed extensions 15*a'* and 15*b'* which bear against ends of turns of a coil spring 16 having a substantially straight extension 16*a* in pressure contact with the inner surface of the bottom wall of the base 11. The coil spring 16 has another extension 16*b* which is engaged at its free end with a selected one of the teeth 17*a* and 17*b* of a teethed member 17 on the inner surface of the cover 12. The arrangement is such that the spring 16 normally biases the cover 12 toward its opened position.

As best shown in FIG. 4, the locking and unlocking means 21 includes a generally box-like housing 22 having a top wall 22*a*, an inwardly and downwardly inclined wall 22*b* and an extension 22*c* extending inwardly from the wall 22*b* substantially parallel with the bottom of the base 11. A resilient member which is in the form of a sponge rubber 23 in the instant embodiment of the invention fills up the space defined by the housing 22 and the front end of the base such that the front end of the housing 22 is upwardly spaced a distance from the vertical front face of the base 11. The housing 22 is rockably mounted on the base 11 by means of mounting pieces 11*a* (only one of which is shown) loosely engaging the housing extension 22*c*. A recess 24 is formed in the inwardly and downwardly inclined wall 22*b* of the housing for the purpose to be described hereunder.

At the position of the vertical frontface of the cover 12 which is longitudinally aligned with the recess 24 in the locking and unlocking housing 22, a projection 25 is formed so as to be snapped into the recess 24 in the housing wall 22*b* when the cover 12 is closed against the biasing force of the spring 16 for thereby locking the cover 12 in the closed position shown in FIG. 1.

When it is desired to open the cover 12, the top 22*a* of the housing 22 of the locking and unlocking means 21 is depressed to lock the housing 22 in counterclockwise direction so that the projection 25 in the cover 12 is released from the recess 24 in the locking housing 22 to allow the cover 12 to move upwardly pivotally about its hinge-connected point by the force of the spring 16. It will be noted that, in place of the sponge rubber 23, the locking and unlocking means 21 may employ any other resilient member such as conventional coil spring (not shown).

As will be best seen in FIGS. 1 and 2, the base 11 and cover 12 cooperate to define a space in which a plurality of sheets of note papers or cards 40 are contained. The cards 40 are bound at their one or rear ends between the rear end of the base 11 and the end member 13 by means of binding rods 18*a* and 18*b* extending from bottom wall of the base 11 upwardly through holes in the rear ends of the cards, as will be seen in FIG. 5. The cards 40 are formed with cutouts 41, FIG. 2 along their edges adjacent that edge of the cover 12 along which the slot 14 is formed. Each of the cards 40 has a different length of the cutout in such a manner that lower is the card on the base 11, the longer is the length of the cutout therein. The purpose of this feature will be made apparent later.

The indexing means 32 includes, in addition to the indexing member shown in FIG. 1 a slider 34 disposed on the inner surface of the cover 12, as shown in FIG. 2 and secured to the indexing member 33 for sliding movement therewith on the inner surface of the cover 12 as best shown in FIG. 6. More specifically, the indexing member 33 is preferably made of a resilient plastic material and has a pair of spaced, downwardly extending and outwardly facing hook-like legs 33*a* and 33*b* which terminate in outwardly directed feet 33*a*-1 and 33*b*-1, respectively. The legs 33*a* and 33*b* slidably extend downwardly through the slot 14 in the cover 12 and are snugly received in an opening in the slider 34 with the feet 33*a*-1 and 33*b*-1 engaging the inner edges of the opening 34*a* in the slider 34 to support the latter from the indexing member 33 as best seen in FIG. 6.

As best seen in FIG. 7, the slider 34 is preferably made of a sheet metal which is formed into a substantially U-shaped profile defined by a top 34*b*, in which the abovementioned opening 34*a* is formed, a bottom 34*c* and a central web 34*d* interconnecting the top 34*b* and the bottom 34*c*. A notch 34*e* is formed in the top 34*b* to form a leaf spring 34*f* integral with the slider 34. The leaf spring 34*f* has a free end bent upwardly and then downwardly to provide an upwardly projecting ridge 34*f*-1 having a relatively rounded top.

Along the slot 14, the cover 12 is formed in the inner surface thereof with a row of a plurality of lateral recesses 19. FIG. 2 in one of which the ridge 34*f*-1 is adapted to rest, as best shown in FIG. 5, when the indexing member and the slider 34 are moved along the slot 14 to a position in front of a selected one of the indexing marks 31 so that the ridge 34*f*-1 and the mating recess 19 cooperate to hold the indexing means 32 at the selected position.

As will be best seen in FIG. 6, the bottom 34*c* of the slider 34 extends horizontally inwardly under the edge portion of the lowermost card of the stack of cards 40 to support the stack from the indexing member 33 and, thus, from the cover 12 of the apparatus. Since the cards 40 are cut-out along their edges adjacent the slider 34 in such a manner that the lower is the card, the longer is the cutout, as described above, if the indexing means 32 is moved along the slot 14 to a position in front of a selected one of the indexing marks, for example, A, on the top of the cover 12, the bottom 34*c* of the slider 34 is in a position not to engage the edge of the card corresponding to the said selected indexing mark, i.e., A, whereby when the cover 12 is opened upon depression of the locking and unlocking member 21, the slider 34 is moved upwardly by the cover 12 together with the cards upper than the card corresponding to the said selected indexing marks 31, i.e., A, as best seen in the enlarged partial illustration in FIG. 5. In other words, a required card corresponding to the selected indexing position of the indexing means 32 is left on the top of the stack of the cards remaining on the base 11 after the cover 12 has been moved to its opened position together with the indexing means 32 with the bottom 34*c* of the slider 34 holding the cards upper than the said required card. Thus, the user can obtain the required information from the notes on the required card.

The indexing apparatus according to the present invention is particularly suited for ready index of a desired telephone number. However, the apparatus of the present invention is not limited to such application and can be used for the index of other information.

In FIG. 8 is shown a second embodiment of indexing means 50, which includes an indexing member 51 and a slider 52. The indexing member includes downwardly extending legs 53,54, which terminate in outwardly directed feet 55,56 respectively. These legs and feet cooperate with an opening 57 defined by a top 58 of the slider 52, similar to the embodiment previously described. In the embodiment of FIG. 8, however, the notch 59 thereof is defined by the web 60 of the slider 52, and cooperates with side recesses 61 defined by the cover 62.

In the embodiment of FIG. 9, a pair of notches 63,64 are defined by extending members which extend from the web 65 of a slider 66. Each of these notches 63,64 cooperate with recesses of the type shown at 61 in FIG. 11 to position the indexing means.

In FIG. 10 is shown yet another embodiment of indexing means, wherein the slider 67 thereof is secured to the indexing member 68 thereof by means of a b[illegible] 69 disposed through an aperture 70 defined by the top 71 of the slider 67, such bolt 69 being in threaded engagement with a threaded bore 72 defined by the indexing member 68. Such embodiment of FIG. 10 is shown in combination with a cover 62 of the device in FIGS. 11 and 12.

What is claimed is:

1. An indexing apparatus comprising:

a base;

a cover connected to said base and having a slot therein, said cover having indexing marks thereon, said cover being movable to an open and a closed position relative to the base;

biasing means for normally biasing the cover toward its open position;

locking and unlocking means for locking the cover relative to the base in its closed position, and allowing the cover to move under the force of the biasing means to its open position;

a plurality of cards on said base, certain ones of said cards being associated with corresponding certain ones of said indexing marks;

indexing means comprising an indexing member movable along said slot to select indexing marks, said indexing member having a pair of spaced legs extending through the slot and terminating in outwardly directed feet, said indexing means further comprising a slider defining a top, a bottom, and a web connecting the top and bottom, and means for securing the slider to the indexing member, cards from said plurality thereof being disposed above said bottom, said top defining a ridge cooperating with recesses defined by the cover holding said indexing means at a selected one of said indexing marks, said bottom holding cards from the plurality thereof upon movement of the cover to its open position, wherein said slider top defines an opening defining inner opening edges and wherein said feet engage the inner edges of the opening defined by the slider top.

2. The indexing apparatus of claim 1 wherein said slider further defines a second ridge cooperating with said recesses defined by the cover along with said first-mentioned ridge.

3. The indexing apparatus of claim 1 wherein said biasing means comprise a coil spring having a first spring extension in contact with the base, and a second spring extension in contact with the cover, the base forming projecting means for supporting said coil spring.

4. In an indexing apparatus or the like having a base and a cover connected to said base, said cover being movable to an open and a closed position relative to the base; the improvement comprising biasing means for normally biasing the cover toward its open position; said biasing means comprising a coil spring having a first spring extension in contact with the base, and a second spring extension in contact with the cover, the base defining projecting means for supporting said coil spring, wherein the base defines first and second laterally aligned projections extending upwardly therefrom, and further comprising first and second inwardly directed extensions extending from said respective projections, on which the coil spring is supported.

* * * * *

UNITED STATES PATENT AND TRADEMARK OFFICE

CERTIFICATE OF CORRECTION

PATENT NO. : 3,987,565

DATED : October 26, 1976

INVENTOR(S) : Chuzo Mori

It is certified that error appears in the above-identified patent and that said Letters Patent are hereby corrected as shown below:

Col. 2, line 42, change "16a" to --15b--;

Col. 4, line 55, the word "bolt" has been omitted.

Signed and Sealed this

Twelfth Day of April 1977

[SEAL]

*Attest:*

RUTH C. MASON
*Attesting Officer*

C. MARSHALL DANN
*Commissioner of Patents and Trademarks*